10/1 /84 4,547,26

United States Patent [19]

Bruno et al.

[11] Patent Number: 4,547,268

[45] Date of Patent: Oct. 15, 1985

[54] PROCESS FOR THE PRODUCTION OF GALVANIZED STEEL SHEET PROTECTED BY CHROMIUM AND CHROMIUM OXIDE LAYERS

[75] Inventors: Roberto Bruno; Massimo Memmi, both of Rome, Italy

[73] Assignee: Zincroksid S.p.A., Turin, Italy

[21] Appl. No.: 579,078

[22] Filed: Feb. 10, 1984

[30] Foreign Application Priority Data

Mar. 21, 1983 [IT] Italy ..... 47950 A/83

[51] Int. Cl.[4] ..... C25D 7/06

[52] U.S. Cl. ..... 204/28; 204/41; 204/56 R

[58] Field of Search ..... 204/27, 28, 40, 41, 204/56 R

[56] References Cited

U.S. PATENT DOCUMENTS 4,411,964 10/1983 Hara et al. ..... 428/626

4,437,944 3/1984 Bruno et al. ..... 204/27

*Primary Examiner*—Andrew H. Metz

*Assistant Examiner*—William T. Leader

*Attorney, Agent, or Firm*—Young & Thompson

[57] ABSTRACT

Improved process for the production of coated steel sheet particularly suitable for the fabrication of car bodies, galvanized and further protected by a layer of metallic chromium and hydrated oxides of chromium. The improvement consists in optimizing process operating conditions, within certain limits, to obtain a protective layer of chromium and hydrated oxides of chromium with absolutely new morphological characteristics which endow the product with corrosion resistance far greater than that of similar products reported in the literature.

3 Claims, No Drawings

PROCESS FOR THE PRODUCTION OF GALVANIZED STEEL SHEET PROTECTED BY CHROMIUM AND CHROMIUM OXIDE LAYERS

The present invention relates to an improved process for the production of coated steel sheet. More precisely, it concerns the optimization of process operating conditions, within certain limits, for depositing on galvanized steel sheet a further protective layer of metallic chromium and hydrated oxides of chromium with absolutely new morphological characteristics, which endow the product with far greater corrosion resistance than that of similar products reported in the literature.

Processes for obtaining similar products have already been described in the literature, for instance in French Pat. No. 2,053,038, British Pat. No. 1,331,844 and Japanese Pat. No. 47-29233; the corrosion characteristics of the products obtained by the processes described in these patent disclosures and confirmed by tests made via specific examinations during the research work that has led to the present invention, are good, but nevertheless they still do not meet the current needs for car body makers, which are very demanding in some cases.

For instance, British Pat. No. 1,331,844 describes a product consisting of galvanized sheet that is further protected with a layer of chromium and chromium oxide. Painted, scratched testpieces of this product subjected to the salt-spray (fog) chamber test as per the ASTM method show signs of white rust and traces of oxidation of the ferrous substrate after 1850 hours, while unpainted testpieces under standard conditions reveal signs of rust after twenty-five hours. These findings are confirmed by tests we have run on products obtained by us experimentally according to this British patent.

Although such products comprise a considerable step ahead compared with conventional galvanized or paint-protected strip sheet, they have not been manufactured commercially both because of their cost and because they were considered less advantageous than prepainted products, about which however, there have since been second thoughts.

Furthermore, for some applications, such as the lower parts of car bodies, particularly exposed to the deleterious effect of trapped moisture and the salt increasingly used to keep roads ice-free, the quality of the galvanized products protected by chromium and oxides of chromium as per the present state of the art still appears unsatisfactory.

The need for further protection of galvanized sheet stems essentially from two facts: the corrosion products of the zinc, which is sacrificial vis-a-vis the ferrous substrate, are incoherent, thus causing the breakaway of the overlying film of paint; secondly, where aeration is poor at a mixed-material joint such as the joint between coated and uncoated steel sheets, or in the vicinity of scratches, the zinc-iron galvanic couple beneath the paint causes local alkalinization that saponifies the paint which peels away, thus aggravating the damage.

These drawbacks are avoided by covering the zinc deposit with chromium; but for cost reasons, the chromium deposit is extremely thin and under the known deposition conditions it occurs in the form of relatively large particles, with average dimensions around 0.1 micron, which leave relatively large areas of zinc uncovered.

The purpose of the further layer of chromium oxides is to cover both the chromium and these bare patches. However, still within the ambit of known depositional conditions, this layer of chromium oxides is sometimes incoherent and discontinuous, and especially fairly soluble in alkalis; therefore, if mixed-material joint conditions occur with the consequent alkalinization of the ambient, this additional protective layer is not very effective.

The object of the present invention is to eliminate these difficulties by providing optimum process conditions which make it possible to obtain galvanized sheet further protected by a superimposed coating of chromium and hydrated oxides of chromium, containing only a limited total quantity of chromium, thus keeping costs reasonable, the morphology of this layer of chromium and oxides of chromium being such as to ensure better corrosion resistance than that of similar coatings described in the literature.

According to this invention the improved process for depositing a protective layer of metallic chromium and oxides of chromium on a galvanized steel sheet is characterized by the following sequence of stages:

Continuously dipping the galvanized steel sheet in an aqueous solution containing from 110 to 170 g/l $CrO_4^{2-}$ ions, from 0.7 to 1.4 g/l $SO_4^{2-}$ ions, from 0.4 to 1 g/l $Cr^{3+}$ ions, from 0.5 to 1.1 g/l $F^-$ ions and from 0.01 to 2 g/l $BF_4^-$ ions, the solution being held at a temperature of between 40 and 55° C. and a pH of between 0.3 and 1, Maintaining a relative velocity of more than 0.5 m/s, preferably between 1 m/s and 3 m/s, between the sheet and the solution, Imposing a cathodic current density of between 40 and 80 A/dm$^2$ on the sheet for a time between 2 and 6 seconds, Extracting the sheet from said bath, eliminating the maximum possible of the adhering solution, Continuously dipping the sheet thus obtained in a second aqueous solution containing from 33 to 52 g/l $CrO_4^{2-}$ ions, from 0.4 to 1 g/l $Cr^{3+}$ ions, from 0.6 to 1.6 g/l $SO_4^{2-}$ ions, from 0.5 to 1.1 g/l $F^-$ ions and from 0.01 to 2 g/l $BF_4^-$ ions, the solution being held at a temperature of between 20° and 35° C. and a pH between 3 and 4.5, Maintaining a relative velocity of more than 0.5 m/s, preferably between 0.5 and 2 m/s, between the sheet and the solution, Imposing a cathodic current density of between 10 and 25 A/dm$^2$ on the sheet for a time between 5 and 20 seconds, and Extracting, rinsing and drying the sheet.

The substances in solution are given in terms of ions participating in the reaction and not as compounds, since costs and availability of suitable chemical compounds can vary considerably from place to place and from time to time; in this way the cost of the solutions can be kept to a minimum without being tied to a rigid formula. Other ions are, of course, present in the solutions but these play no specific role and so they are not mentioned.

With the restrictive operating conditions indicated above, a product having exceptionally good corrosion resistance is obtained.

The zinc-coated sheet thus treated has an outer protective layer containing from 0.2 to 1.0 g/m$^2$ total chromium, typically from 0.4 to 0.6 g/m$^2$, with between 80 and 90% metallic chromium, the remainder being in the form of the chromium in the oxides.

The excellent corrosion resistance properties are attributable to the fact that, under the above process conditions, the metallic chromium is deposited as very fine discrete, crystalline, superposed particles having average gaussian dimensions of around 0.03 micron, at least 40% by volume of the metallic chromium being in the form of particles having a maximum size of less than 0.02 micron. The maximum statistical particle size is about 0.07–0.08 micron. In this manner almost perfect coverage of the zinc is ensured, since the average size of the areas that remain uncoated is less than 0.02 micron, while the total area of zinc remaining uncoated is less than 0.1% of the total area. This value has been ascertained by inspection under a transmission electron microscope of the metallic chromium layer detached from the zinc substrate. No breaks in the coating are to be seen at a magnification of 60,000 times.

The layer of chromium oxides, deposited in colloidal amorphous form, plays an important role in ensuring the corrosion resistance of the product. This is because the colloidal layer provides almost perfect coverage of the whole surface of the strip and is present also in the very small zones hidden by the edges of the metallic chromium particles. There is also the fact that a short time after the treatment has been completed, this layer of chromium oxides becomes virtually insoluble in water and alkalis and only very slightly soluble in acids.

The exact nature of this deposit is still unknown because the quantity involved is so small that it cannot be fully characterized chemically, while as it is amorphous, physical methods of analysis such as X-ray diffraction cannot be applied. Physical methods of chemical microanalysis, such as micro-probes and the like are equally inapplicable due to the thinness of the deposit, which results in there being interference from the underlying layers. However, the layer contains non-metallic chromium and, considering the fact that it is insoluble in water and alkalis and only very slightly soluble in acids, it is assumed that it consists essentially of a partially-hydrated form of $Cr_2O_3$.

The product obtained as per the improved process that is the subject of the present invention is endowed with excellent corrosion resistance, as already mentioned. A series of testpieces—unpainted, paint and X-scratched, and painted and deep-drawn (Eriksen-)—were salt-spray tested (5% NaCl) in the fog chamber as per the ASTM B 117 method. On 5% of the unpainted testpieces, the first rust marks appeared after 900 hours, on 20% after 1200 hours, while after 1500 hours 40% of them still showed no sign of rust. In the case of the cataphoreticallypainted test pieces with an X-scratch or deep drawn, there was no trace of rusting even after 2000 hours. There was virtually no lifting of the paint at the edges of the scratches, while in areas farther away there was no blistering. Comparative tests performed by the ASTM B 117 method, using sheet treated as per known processes showed that the unpainted testpieces began to rust after between 20 and 100 hours, while the painted, scratched testpieces revealed traces of rusting after 800–1800 hours, as well as frequent, small paint blisters.

Electrochemical tests of galvanic coupling between sheets coated as per the present invention and bare steel sheets have shown this to be virtually nonexistent, thus signifying that the problem of the mixed-material joint has been practically eliminated.

EXAMPLES 1–3

Coils of galvanized steel strip in industrial sizes of widths between 1 and 1.5 m and a thickness between 0.5 and 1 mm are subjected to the following operations:

| First Bath (to deposit metallic chromium) | Example 1 | Example 2 | Example 3 | |
|---|---|---|---|---|
| $CrO_3$ to form | 110 | 140 | 165 | g/l of $CrO_4^{2-}$ |
| $H_2SO_4$ (100%) | 0.8 | 0.8 | 0.8 | g/l |
| $Cr^{+3}$ (formed by reduction of $CrO_4^{2-}$) | 0.5 | 0.5 | 0.7 | g/l |
| NaF to form | 0.5 | 0.8 | 0.6 | g/l of $F^-$ |
| $HBF_4$ (100%) to form | 0.9 | 0.9 | 0.9 | g/l of $BF_4$ |
| Current density | 50 | 55 | 60 | $A/dm^2$ |
| Treatment time | 5 | 4 | 3 | sec. |
| Deposit of metallic chromium | 0.5 | 0.55 | 0.6 | $g/m^2$ |

In each example, the pH is maintained at 0.75, the temperature at 45°–50° C., and the relative velocity of the strip and the solution at 2.6 m/sec.

| Second Bath (to form chromium oxide deposit) | Example 1 | Example 2 | Example 3 | |
|---|---|---|---|---|
| $CrO_3$ to form | 40 | 43 | 47 | g/l of $CrO_4^{2-}$ |
| $H_2SO_4$ (100%) | 0.7 | 0.7 | 0.7 | g/l |
| $Cr^{+3}$ (formed by reduction of $CrO_4^{2-}$) | 0.6 | 0.7 | 0.7 | g/l |
| $H_2O_2$ 36 vol (to reduce $CrO_4^{2-}$ to $Cr^{+3}$) | 1.5 | 2 | 2 | ml/l |
| NaF to form | 0.7 | 0.8 | 0.8 | g/l of $F^-$ |
| $HBF_4$ (100%) to form | 0.06 | 0.09 | 0.2 | g/l of $BF_4^-$ |
| NaOH up to | 15 | 15 | 15 | g/l |
| Current density | 20 | 15 | 15 | $A/dm^2$ |
| Treatment time | 12 | 18 | 15 | sec. |
| Chromium content of chromium oxide deposit | 0.12 | 0.06 | 0.10 | $g/m^2$ |

In this second bath, the pH is maintained between 3 and 3.5, temperature between 25° and 28° C., and relative velocity of strip and solution 1.8 m/sec.

Under salt spray test (ASTM B 117) of the resulting unpainted and painted specimens, the following results are obtained (in hours to form the first traces of rust):

| | Example 1 | Example 2 | Example 3 | |
|---|---|---|---|---|
| Unpainted | >1100 | >950 | >1100 | hours |
| Painted | >2300 | >2000 | >2500 | hours |

What is claimed is:

1. Process for the production of coated steel sheet, comprising depositing on a galvanized steel sheet a protective layer of chromium and oxides of chromium, comprising:

continuously immersing a galvanized steel strip in an aqueous solution containing from 110 to 170 g/l $CrO^{2-}$ ions, from 0.7 to 1.4 g/l $SO_4^{2-}$ ions, from 0.4 to 1.0 g/l $Cr^{3-}$ ions, from 0.5 to 1.1 g/l $F^-$ ions and from 0.01 to 2 g/l $BF_4^-$ ions, the solution being at a temperature of between 40° and 55° C. and a pH of between 0.3 and 1, maintaining a relative velocity of more than 0.5 m/s between the strip and the solution, imposing a cathodic current density of between 40 and 80 $A/dm^2$ on the strip for a time of between 2 and 6 seconds, removing the strip from said first solution, eliminating most of the adhering solution, continuously immersing the strip thus obtained in a second aqueous solution containing from 33 to 52 g/l $Cr_4^{2-}$ ions, from 0.4 to 1.0 g/l $Cr^{3+}$ ions, from 0.6 to 1.6 g/l $SO_4^{2-}$ ions, from 0.5 to 1.1 g/l $F^-$ ions and from 0.01 to 2 g/l $BF_4^-$ ions, the second solution being at a temperature of between 20° and 35° C. and a pH between 3 and 4.5, maintaining a relative velocity of more than 0.5 m/s between the strip and the second solution, imposing a cathodic density of between 10 and 25 $A/dm^2$ on the strip for a time of between 5 and 20 seconds, and removing the strip from said second solution and rinsing the drying it.

2. A process as claimed in claim 1, in which in said first aqueous solution, the relative velocity between the strip and the solution is between 1 and 3 m/s.

3. A process as claimed in claim 1, in which in said second aqueous solution, the relative velocity between the strip and the solution is between 0.5 and 2 m/s.

* * * * *